US009757977B2

(12) United States Patent
DeLeo et al.

(10) Patent No.: US 9,757,977 B2
(45) Date of Patent: Sep. 12, 2017

(54) CHALK LINE

(71) Applicant: Irwin Industrial Tool Company, Huntersville, NC (US)

(72) Inventors: Anthony DeLeo, Portage, MI (US); Gregory David Parker, Charlotte, NC (US)

(73) Assignee: IRWIN INDUSTRIAL TOOL COMPANY, Huntersville, NC (US)

( * ) Notice: Subject to any disclaimer, the term of this patent is extended or adjusted under 35 U.S.C. 154(b) by 60 days.

(21) Appl. No.: 14/833,952

(22) Filed: Aug. 24, 2015

(65) Prior Publication Data

US 2016/0052332 A1 Feb. 25, 2016

Related U.S. Application Data

(60) Provisional application No. 62/040,679, filed on Aug. 22, 2014.

(51) Int. Cl.
*B44D 3/38* (2006.01)

(52) U.S. Cl.
CPC ..... *B44D 3/38* (2013.01)

(58) Field of Classification Search
CPC ..... B44D 3/38
USPC ..... 33/414
See application file for complete search history.

(56) References Cited

U.S. PATENT DOCUMENTS

| | | | | |
|---|---|---|---|---|
| 1,567,976 | A | 12/1925 | Myers | |
| 3,888,010 | A * | 6/1975 | Hyde | B44D 3/38 33/414 |
| 5,644,852 | A | 7/1997 | Fuller et al. | |
| 6,915,587 | B1 | 7/2005 | Scillia et al. | |
| 7,197,831 | B2 | 4/2007 | Nepil | |
| 7,536,799 | B2 | 5/2009 | Nepil et al. | |
| 7,770,300 | B2 | 8/2010 | Johnson | |
| 2007/0240320 | A1 * | 10/2007 | Hickey | B44D 3/38 33/414 |
| 2008/0236442 | A1 * | 10/2008 | Spaulding | B44D 3/38 33/414 |
| 2008/0301959 | A1 * | 12/2008 | Nepil | B44D 3/38 33/414 |
| 2012/0260511 | A1 * | 10/2012 | Spaulding | B44D 3/38 33/414 |
| 2016/0052332 | A1 * | 2/2016 | DeLeo | B44D 3/38 33/414 |
| 2016/0167425 | A1 * | 6/2016 | Chernyshou | C09D 13/00 33/414 |

* cited by examiner

*Primary Examiner* — Yaritza Guadalupe-McCall
(74) *Attorney, Agent, or Firm* — Eversheds Sutherland (US) LLP

(57) ABSTRACT

A chalk line is disclosed herein. The chalk line may include a housing, a track, and a door. The housing may define a chalk chamber and an opening in communication with the chalk chamber. The track may be disposed adjacent the opening and may include a curved section. The door may be movable between a closed position preventing access to the chalk chamber through the opening and an open position allowing access to the chalk chamber through the opening, and the door may include one or more door segments pivotably connected to one another by one or more hinges.

20 Claims, 7 Drawing Sheets

CHALK LINE

CROSS-REFERENCE TO RELATED APPLICATIONS

The present application claims priority to and the benefit of U.S. Provisional Application No. 62/040,679, filed on Aug. 22, 2014, entitled "CHALK LINE," which is hereby incorporated by reference in its entirety.

FIELD OF THE DISCLOSURE

The present disclosure generally relates to chalk line marking devices commonly referred to as chalk reels, chalk spools, chalk boxes, or chalk lines (hereinafter referred to as "chalk lines") and more particularly relates to a chalk line including an opening and a door for accessing a chamber of the chalk line.

BACKGROUND

Various types of chalk lines are known in the art, which typically may include a spool on which a line or string is wound. The spool, the line, and a drive transmission for the spool may be supported in a housing of the chalk line. According to certain configurations, the drive transmission may include gears, springs, and other components that connect the spool to an external handle for rewinding the line on the spool after use of the chalk line. The chalk line may include a chamber that is filled or partially filled with a colored chalk and arranged such that the line is coated in chalk as the line is wound on the spool. During use of the chalk line, the coated line may be unwound from the spool and pulled out of the housing through an aperture, such that the coated line may be "snapped" on a surface to form a line of chalk on the surface. The resulting line of chalk may be used as a reference line in construction or other applications.

After repeated use of the chalk line, the supply of chalk in the chamber may become depleted. The chalk line may include an opening that may be used to visually determine the level of chalk in the chamber and to refill the chamber with chalk, when necessary. The opening also may be used to visually inspect the spool and the line. A door or cover of the chalk line may be provided within or adjacent the opening to control access to the chamber. The door may be movable between a closed position preventing access to the chamber through the opening and an open position allowing access to the chamber through the opening, for example, for determining the level of chalk in the chamber, refilling the chamber with chalk, or inspecting the spool and the line.

The opening and the door of certain chalk lines may be configured such that a relatively small access window is provided when the door is in the open position. Such configurations may cause a user to experience problems in determining the level of chalk in the chamber, refilling the chamber with chalk, and/or inspecting the spool and the line.

SUMMARY

Some or all of the needs and/or problems noted above may be addressed by certain embodiments of the chalk line disclosed herein. In one embodiment, a chalk line may include a housing, a track, and a door. The housing may define a chalk chamber and an opening in communication with the chalk chamber. The track may be disposed adjacent the opening and may include a curved section. The door may be movable between a closed position preventing access to the chalk chamber through the opening and an open position allowing access to the chalk chamber through the opening, and the door may include two or more door segments pivotably connected to one another by two or more hinges.

In another embodiment, a chalk line may include a housing, a pair of tracks, and a door. The housing may define a chalk chamber and an opening in communication with the chalk chamber. The tracks may be disposed adjacent the opening and each of the tracks may include a linear section and a curved section. The door may be movable between a closed position preventing access to the chalk chamber through the opening and an open position allowing access to the chalk chamber through the opening. The door may include two or more door segments pivotably connected to one another by two or more living hinges.

In still another embodiment, a chalk line may include a housing, a track, and a door. The housing may define a chamber and an opening in communication with the chamber. The track may be disposed adjacent the opening. The door may be movable between a closed position preventing access to the chamber through the opening and an open position allowing access to the chamber through the opening, and the door may include two or more door segments pivotably connected to one another by two or more hinges.

Other features and aspects of the chalk line will be apparent or will become apparent to one of ordinary skill in the art upon review of the following figures and the detailed description.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 4:
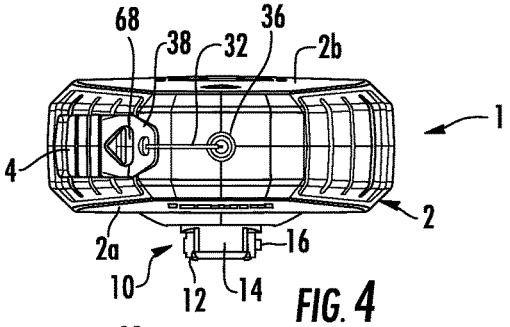
FIG. 4 is a top view of the chalk line of FIG. 1.
Figure 2:
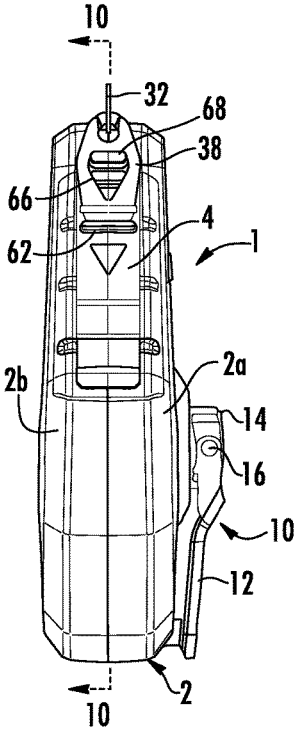
FIG. 2 is a side view of the chalk line of FIG. 1.
Figure 1:
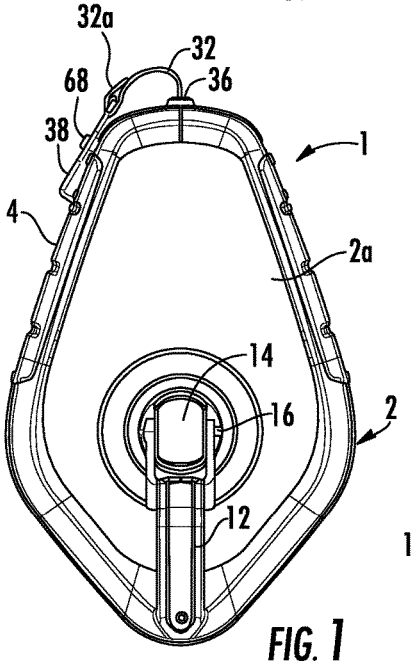
FIG. 1 is a front view of a chalk line in accordance with one or more embodiments of the disclosure.
Figure 3:
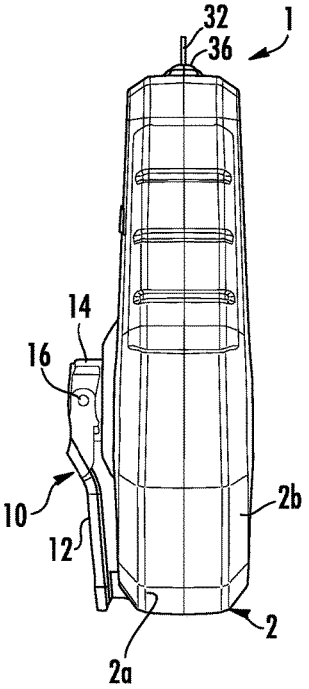
FIG. 3 is an opposite side view of the chalk line of FIG. 1.
Figure 5:
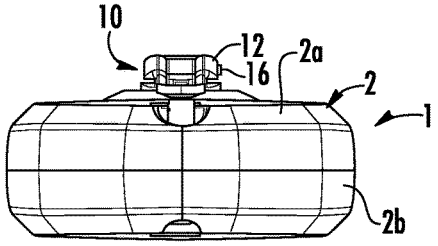
FIG. 5 is a bottom view of the chalk line of FIG. 1.
Figure 7:
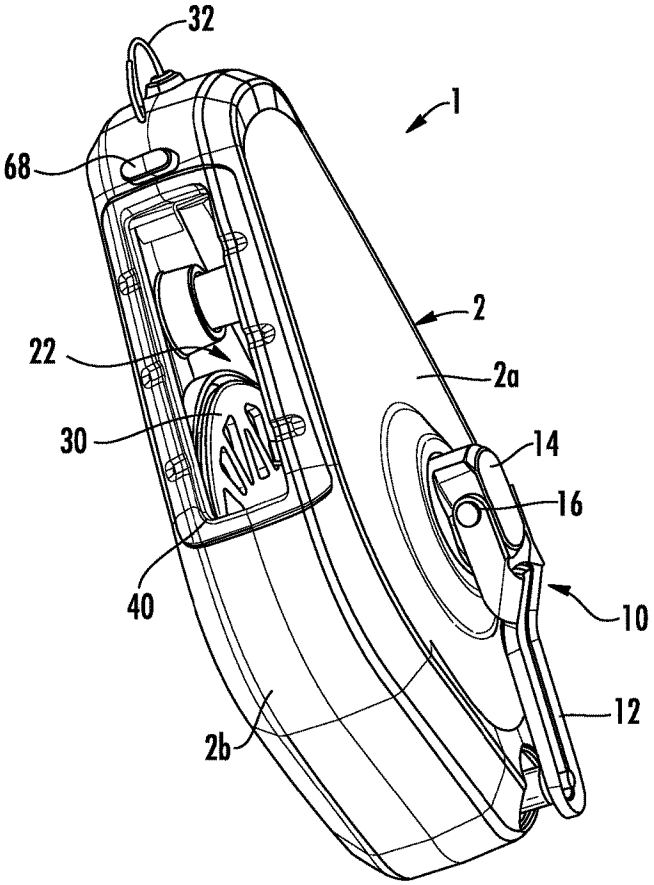
FIG. 7 is a perspective view of the chalk line of FIG. 1, with the door of the chalk line removed.
Figure 6:
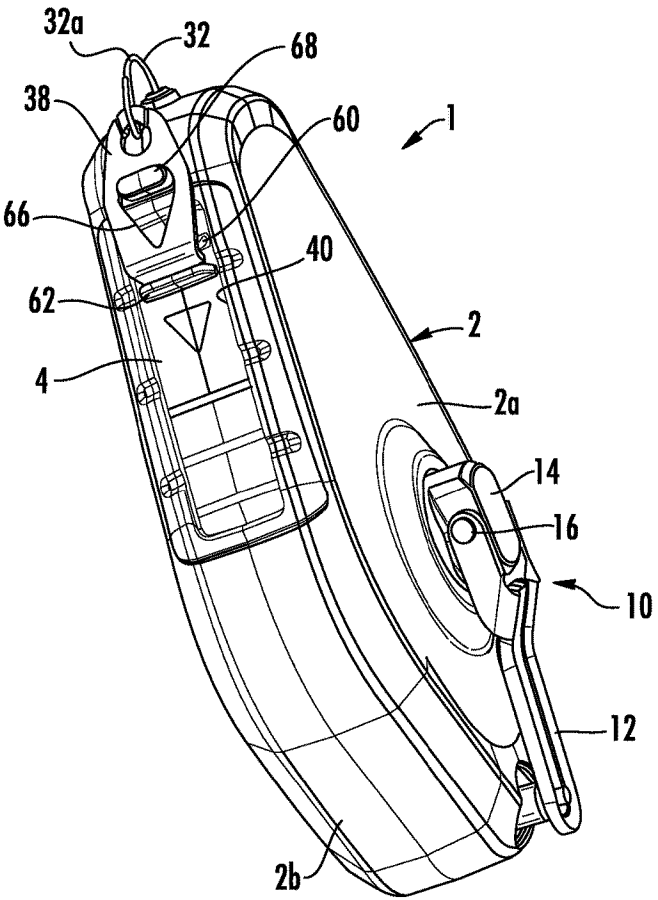
FIG. 6 is a perspective view of the chalk line of FIG. 1, with a door of the chalk line in a closed position.

Described below are embodiments of a chalk line as well as individual components of the chalk line. The chalk line may be used to form a line of chalk on a surface, which may serve as a reference line in construction or other applications. As described below, the chalk line may be configured to provide a user with improved access to a chamber of the chalk line, such that the user may easily determine a level of chalk in the chamber, refill the chamber with chalk, and/or inspect a spool and a line of the chalk line.

Generally described, the chalk line may include a housing, a track, and a door. The housing may define a chalk chamber and an opening in communication with the chalk chamber. The track may be disposed adjacent the opening and may include a curved section. The door may be movable between a closed position preventing access to the chalk chamber through the opening and an open position allowing access to the chalk chamber through the opening, and the door may include two or more door segments pivotably connected to one another by two or more hinges.

The door of the chalk line may be made of a relatively flexible material. In certain embodiments, the relatively flexible material may be polypropylene, although other suitable materials may be used. In certain embodiments, the hinges of the door may be living hinges. Alternatively, the hinges of the door may be other forms of mechanical hinges, such as snap-fit hinges or pin-based hinges. In certain embodiments, the curved section of the track may follow a curved exterior shape of the housing. The chalk line also may include a spool disposed within the housing. In certain embodiments, the curved section of the track may follow a curved exterior shape of the spool. In certain embodiments, the door may include an overmold portion disposed along an interior side of the door. The overmold portion may be disposed over the hinges of the door. The chalk line also may include a line supported by the spool, and the line may include a first end extending outside of the housing and removably attached to the door. The chalk line further may include an end hook attached to the first end of the line. In certain embodiments, the door may include a retaining member disposed along an exterior side of the door and configured to removably receive and retain a portion of the end hook. The chalk line also may include a lock configured to maintain the door in the closed position. In certain embodiments, the lock may include a projection disposed on one of the door and the housing, and a receptacle defined in another one of the door and the housing and configured to removably receive and retain a portion of the projection. In certain embodiments, the housing may include a stop projection, and the door may include a catch projection configured to engage the stop projection to limit movement of the door in an opening direction.

The opening and the door may define an access window when the door is in the open position. In certain embodiments, the access window may have an area of approximately 0.616 $in^2$ (397.42 $mm^2$). In certain embodiments, the access window may have an area greater than 0.5 $in^2$ (322.58 $mm^2$). In certain embodiments, the access window may have an area greater than 0.6 $in^2$ (387.10 $mm^2$). In certain embodiments, the access window may have an area between 0.6 $in^2$ (387.10 $mm^2$) and 0.7 $in^2$ (451.61 $mm^2$). In certain embodiments, the access window may have an area between 0.5 $in^2$ (322.58 $mm^2$) and 0.8 $in^2$ (516.13 $mm^2$). In certain embodiments, the access window may have an area between 0.6 $in^2$ (387.10 $mm^2$) and 0.75 $in^2$ (483.87 $mm^2$).

These and other embodiments of the disclosure are described in more detail through reference to the accompanying drawings in the detailed description that follows. This brief overview, including section titles and corresponding summaries, is provided for the reader's convenience and is not intended to limit the scope of the claims or the preceding sections. Furthermore, the techniques described above and below may be implemented in a number of ways and in a number of contexts. Several example implementations and contexts are provided with reference to the accompanying drawings, as described below in more detail. However, the following implementations and contexts are but a few of many.

Illustrative Embodiments

FIGS. 1-20 illustrate a chalk line 1 (which also may be referred to as a "chalk reel," a "chalk spool," or a "chalk box") as well as individual components of the chalk line 1 in accordance with one or more embodiments of the disclosure. The chalk line 1 may include a housing 2. As shown, the housing 2 may include a front housing 2*a* (which also may be referred to as a "front housing portion") and a back housing 2*b* (which also may be referred to as a "back housing portion"). In certain embodiments, the front housing 2*a* and the back housing 2*b* may be connected to one another by one or more fasteners 3, such as threaded screws, pins, rivets, clasps, or other connection mechanisms. In certain embodiments, the front housing 2*a* and the back housing 2*b* may be connected to one another by an adhesive, welding, or a mechanical snap-fit connection or the like, either in addition to or instead of the fasteners 3. It will be appreciated that, according to various embodiments, the housing 2 may include other components in addition to or instead of the front housing 2*a* and the back housing 2*b*, and the various components of the housing 2 may be connected to one another by one or more connection mechanisms. In certain embodiments, one or more portions of the housing 2 may have a curved exterior shape, and one or more portions of the housing 2 may have a linear exterior shape. For example, the housing 2 may have a generally "teardrop" shape, as shown in FIGS. 1-11 and 18-20, including portions having a curved exterior shape and portions having a linear exterior shape. The teardrop shape of the housing 2 may allow a user to easily grasp and hold the chalk line 1 in an ergonomically suitable manner. It will be appreciated, however, that the housing 2 may have other shapes, according to other embodiments of the chalk line 1.

As shown, the chalk line 1 may include a spool drive mechanism 10. The spool drive mechanism 10 may include a rewind handle 12 that is mounted for rotary motion relative to the housing 2. The rewind handle 12 may be connected to a rotary member 14 by a pivot connection 16. In this manner, the rewind handle 12 may be pivoted from a locked position, as shown in FIGS. 1-7, to an extended position in which the rewind handle 12 may be used to rotate the rotary member 14. In certain embodiments, the pivot connection 16 may include a pin extending through respective portions of the rewind handle 12 and the rotary member 14, as shown. The rotary member 14 may be operatively connected to a spool 30 (which also may be referred to as a "take up reel" or a "reel") such that when the rewind handle 12 is rotated in a first direction, the spool 30 is rotated to rewind a line 32 (which also may be referred to as a "string") into the housing 2 and onto the spool 30. During use of the chalk line 1, when the line 32 is pulled from the housing 2 and unwound from the spool 30, the rotary member 14 may rotate in a second direction opposite the first direction. In certain embodiments, a transmission (which also may be referred to as a "drive transmission"), such as a gear train, may operatively connect the rotary member 14 to the spool 30. As shown, the spool 30 may be disposed within the housing 2, the rotary member 14 may be disposed partially within the housing 2 and partially outside of the housing 2, and the rewind handle 12 may be disposed outside of the housing 2.

The line 32 may include a first end 32*a* (which also may be referred to as a "free end") and a second end (which also may be referred to as a "secured end"). When the chalk line 1 is in a storage configuration (i.e., when the chalk line 1 is not being used), as shown in FIGS. 1-5, a majority of the line 32 may be supported by the spool 30. In particular, a majority of the line 32 may be wound on the spool 30, while a portion of the line 32, including the first end 32*a* thereof, may extend outside of the housing 2 through an aperture 36 (which also may be referred to as a "line aperture") defined in the housing 2, as shown. An end hook 38 may be attached to the first end 32*a* of the line 32. The end hook 38 may be configured to allow the line 32 to be temporarily attached to a structure, such as a workpiece or working surface, during use of the chalk line 1. The end hook 38 also may be configured to allow the line 32 to be temporarily attached to another portion of the chalk line 1, as described below, when the chalk line 1 is not being used. The housing 2 may define a chalk chamber 22 (which also may be referred to as an "internal chamber" or simply a "chamber") therein. The chalk chamber 22 may be filled or partially filled with a colored chalk. During use of the chalk line 1, the line 32 may pass through the chalk chamber 22 such that the line 32 is impregnated or coated with chalk as the line 32 is retracted into and/or extended from the housing 2.

Figure 20:
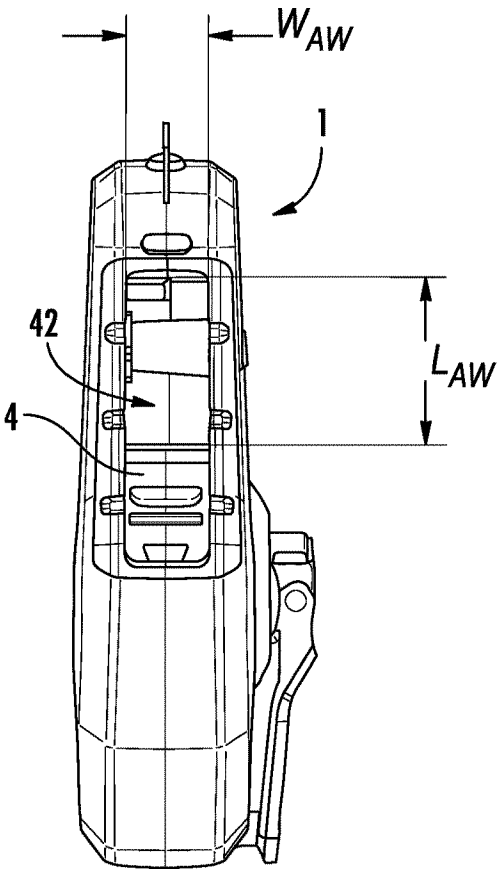
FIG. 20 is a side view of the chalk line of FIG. 1, with the door of the chalk line in the open position, showing a width and a length of an access opening defined by the door and an opening of the chalk line.
Figure 19:
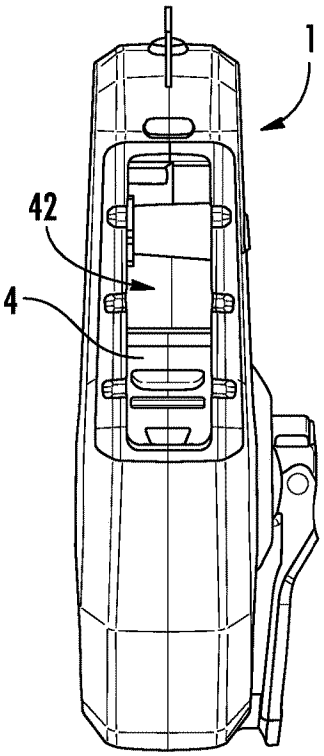
FIG. 19 is a side view of the chalk line of FIG. 1, with the door of the chalk line in the open position.
Figure 18:
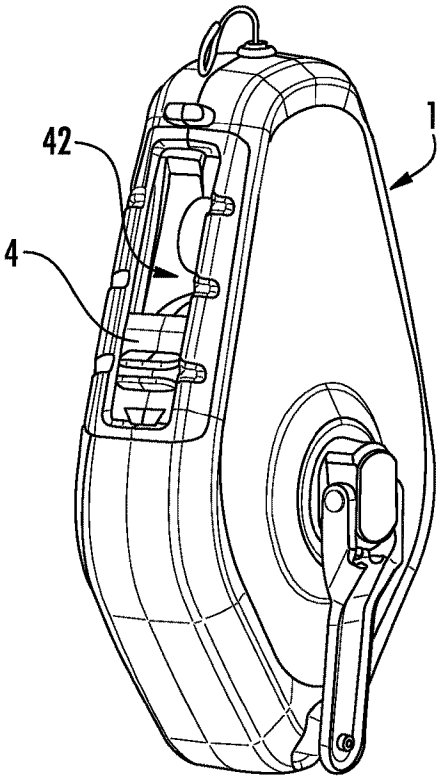
FIG. 18 is a perspective view of the chalk line of FIG. 1, with the door of the chalk line in an open position.

The chalk chamber 22 may be accessed via an opening 40 (which also may be referred to as a "chalk fill opening" or an "inspection opening") defined in the housing 2 and in communication with the chalk chamber 22. As shown, the chalk line 1 may include a door 4 (which also may be referred to as a "chalk fill door," a "fill door," a "cover," or a "fill cover") disposed adjacent the opening 40. Although the door 4 may be described as being disposed adjacent the opening 40, it will be appreciated that one or more portions of the door 4 may be disposed at least partially within or may extend through the opening 40. The front housing 2*a* and the back housing 2*b* may trap (i.e., capture) the door 4 therebetween, such that the door 4 may slide relative to the housing 2 and the opening 40 between a closed position, as shown in FIGS. 1-6, and an open position, as shown in FIGS. 18-20. When the door 4 is in the closed position, the door 4 may prevent access to the chamber 22 through the opening 40. Additionally, when the door 4 is in the closed position, the opening 40 may be sealed by the door 4 such that the chalk may not escape from the chamber 22. When the door 4 is in the open position, the chamber 22 of the housing 2 may be accessed through the opening 40. In this manner, the door 4 and the opening 40 may allow access to the chamber 22 for determining the level of chalk in the chamber 22, refilling the chamber 22 with chalk, or inspecting or maintaining internal components of the chalk line 1, such as the spool 30, the line 32, or the like. When the door 4 is in the open position, the chalk line 1 may define an access window 42 through which a user may access the chamber 22. In certain embodiments, as shown, when the door 4 is in the open position, the opening 40 and the door 4 may define the access window 42 therebetween. According to such embodiments, a portion of the door 4 may block a portion of the opening 40, as shown, when the door 4 is in the open position. In this manner, the access window 42 may be a portion of the opening 40 that is not blocked by the door 4 (i.e., an open portion of the opening). In other words, when the door 4 is in the open position, the access window 42 may be defined by a portion of the housing 2, such as one or more edges of the housing 2 that define the opening 40, and a portion of the door 4, such as one or more edges of the door 4 that are disposed adjacent the opening 40 when the door 4 is in the open position. For example, as shown in FIGS. 18-20, the access window 42 may be defined by two lateral edges and one end edge of the housing 2 that define the opening 40 and one end edge of the door 4 that is disposed adjacent the opening when the door 4 is in the open position. In certain other embodiments, when the door 4 is in the open position, the access window 42 may be defined entirely by the opening 40. According to such embodiments, no portion of the door 4 blocks any portion of the opening 40 when the door 4 is in the open position. In this manner, the opening 40 itself may provide the access window 42. In other words, when the door 4 is in the open position, the access window 42 may be defined by a portion of the housing 2, such as one or more edges of the housing 2 that define the opening 40. For example, the access window 42 may be defined by two lateral edges and two end edges of the housing 2 that define the opening 40.

Certain embodiments of a chalk line have been identified as having a relatively large chalk fill opening or access window which may be useful because a user may be better able to discern or otherwise visualize a level of chalk in a chamber of the chalk line and also may be better able to determine whether a spool and a line of the chalk line are in suitable working order. The arrangement of the opening 40 and the door 4 of the chalk line 1 described herein provides a relatively large access window, which may be about 50% larger than that provided by certain existing chalk lines, thereby providing improved access into the chamber 22 of the housing 2. Notably, the ergonomically suitable teardrop shape of the housing 2, as shown in FIGS. 1-11 and 18-20, may present certain challenges in providing a relatively large chalk fill opening and a solid, rigid (i.e., not flexible) door that is slidable with respect to the opening for controlling access therethrough. In particular, a solid, rigid door uses a linear track to slide into when the door is moved to an open position, and the teardrop shape provides a limited amount of space for accommodating a linear track for a large, solid, rigid door. Providing a linear track that is able to accommodate a large, solid, rigid door could, in certain instances, compromise the ergonomic teardrop shape of the housing 2.

As described above, the chalk line 1 may include the door 4 disposed adjacent the opening 40 and movable between the closed position preventing access to the chalk chamber 22 through the opening 40 and an open position allowing access to the chalk chamber 22 through the opening 40. In this manner, the opening 40 may be selectively closed by the door 4. In certain embodiments, the door 4 may be made of a relatively flexible or pliable material that allows the door 4 to flex as the door 4 moves along a door track 50 (which also may be referred to as a "track"). As an example, the relatively flexible or pliable material may be polypropylene, although other suitable materials may be used. In certain embodiments, one or more portions of the door 4 may be made of a relatively flexible or pliable material, and one or more other portions of the door 4 may be made of a relatively rigid material, such that the overall door 4 may flex as the door 4 moves along the door track 50. As described in detail below, the door 4 may include a number of "living hinge" sections 52 (which also may be referred to as "living hinges" or simply "hinges") and a number of relatively rigid, door segments 54 (which also may be referred to as "rigid segments" or simply "segments"). The living hinge sections 52 may allow the door 4 to flex as the door 4 moves along the door track 50.

Figure 9:
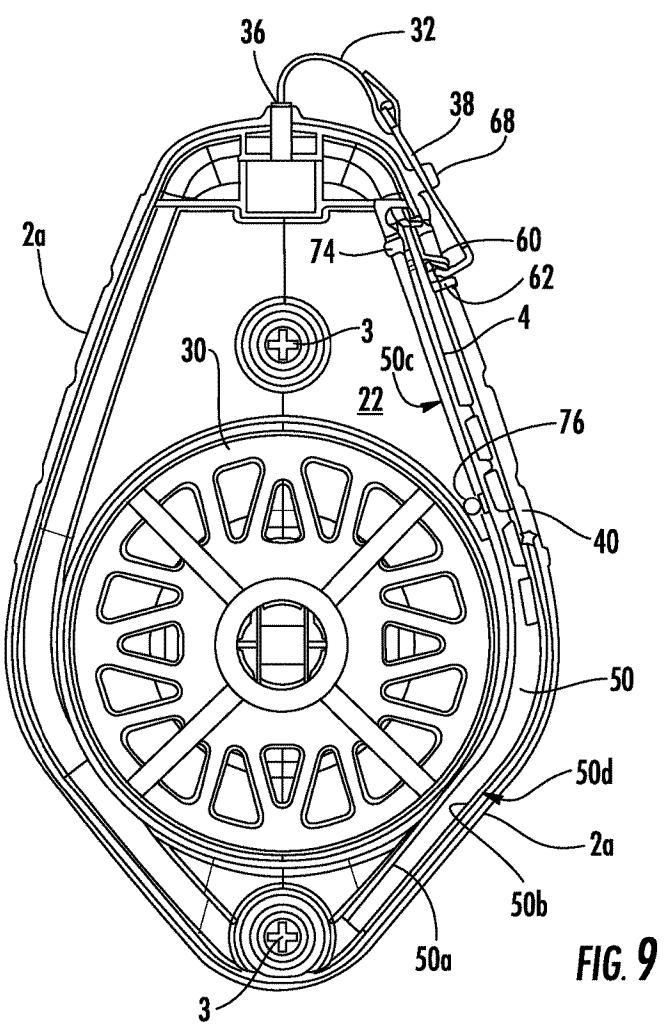
FIG. 9 is a back view of the chalk line of FIG. 1, with a back housing of the chalk line removed and the door of the chalk line in the closed position.
Figure 8:
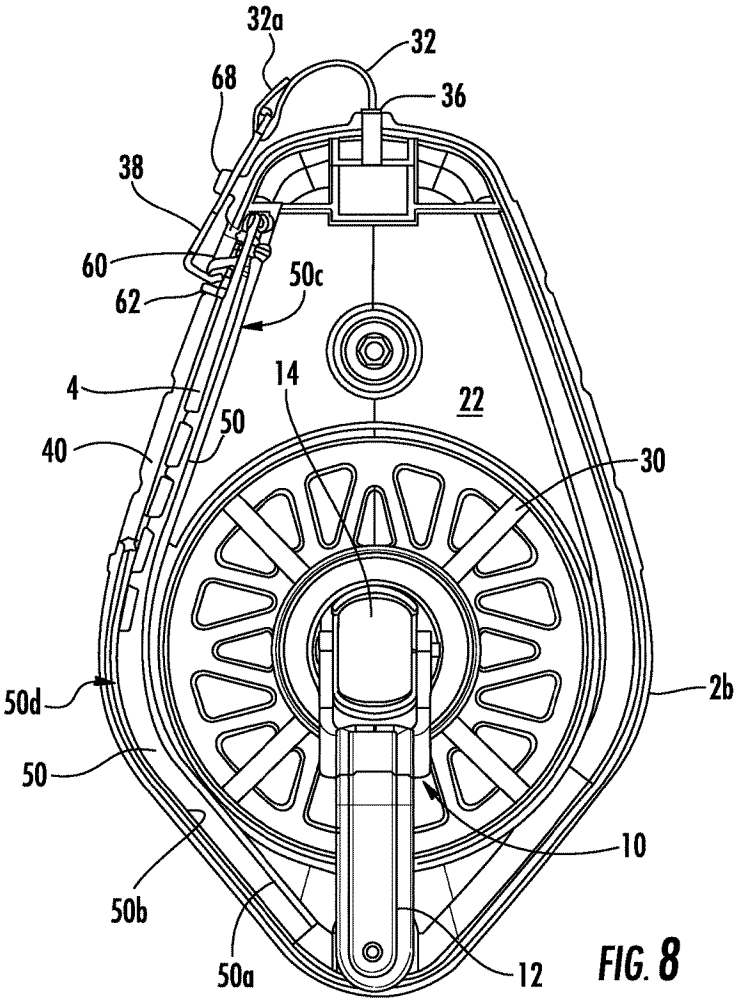
FIG. 8 is a front view of the chalk line of FIG. 1, with a front housing of the chalk line removed and the door of the chalk line in the closed position.

As shown in FIGS. 8 and 9, each of the front housing 2*a* and the back housing 2*b* may include a door track 50. Each door track 50 may be defined by an inner track rail 50*a* and an outer track rail 50*b*, as shown. For each door track 50, the inner track rail 50*a* and the outer track rail 50*b* may be spaced from one another and configured to receive a respective lateral edge of the door 4 therebetween while allowing the door 4 to slide within the door tracks 50. The door tracks 50 of the front housing 2*a* and the back housing 2*b* may be opposed to one another in the assembled housing 2 such that the door 4 is trapped in the opposed door tracks 50. The door 4 may be free to slide within the opposed door tracks but otherwise may be captured by the housing 2. As shown, each door track 50 may include a linear section 50*c* and a curved section 50*d*. The linear section 50*c* may be disposed adjacent the opening 40. The curved section 50*d* may extend from the linear section 50*c* and may follow a curvature of the housing 2. For example, the curved section 50*d* may follow a curved exterior shape of the housing 2, as shown. Additionally or alternatively, the curved section 50*d* may follow a curved exterior shape of the spool 30. In certain embodiments, as shown, the respective door tracks 50 may be integrally formed with a remainder of the respective front housing 2*a* and back housing 2*b*. In certain other embodiments, the respective door tracks 50 may be separately formed and attached to a remainder of the respective front housing 2*a* and back housing 2*b*. The door 4 may be dimensioned and configured to fit against the opening 40 to seal the chalk in the chalk chamber 22. The living hinge sections 52 may be thin sections molded into the door 4. The living hinge sections 52 may be configured to flex so that the adjacent, relatively rigid, door segments 54 may pivot relative to each other at the living hinge sections 52. The door tracks 50 may follow the curved exterior shape of the teardrop shaped housing 2. The exterior shape of the housing 2 may be modified slightly such that the door tracks 50 have a radius that follows the curved exterior shape of the spool 30. The living hinge sections 52 of the door 4 allow the door 4 to follow the linear sections 50*c* and the curved sections 50*d* of the door tracks 50.

The use of the flexible door 4 allows the opening 40 provided in the curved housing 2 to be relatively large. As described above, when the door 4 is in the open position, the chalk line 1 may define the access window 42 through which a user may access the chamber 22. In certain embodiments, when the door 4 is in the open position, the opening 40 and the door 4 may define the access window 42 therebetween (i.e., the door 4 may be positioned such that the door 4 blocks a portion of the opening 40), as shown in FIGS. 18-20. In certain other embodiments, when the door 4 is in the open position, the access window 42 may be defined entirely by the opening 40 (i.e., the door 4 may be positioned such that the door 4 does not block any portion of the opening 40). The door 4 and the opening 40 may be dimensioned and configured such that the resulting access window 42 is relatively large, thereby allowing a user to easily determine a level of chalk in the chalk chamber 22, refill the chalk chamber 22 with chalk, and/or inspect the spool 30 and the line 32 within the housing 2. In certain embodiments, as shown, the opening 40 and the access window 42 each may have a rectangular shape. The rectangular access window 42 may have a width $W_{AW}$ and a length $L_{AW}$, as shown in FIG. 20. In certain embodiments, the width $W_{AW}$ of the access window 42 may be defined by two lateral edges of the housing 2 that define the lateral sides of the opening 40, and the length $L_{AW}$ of the access window 42 may be defined by one end edge of the housing 2 that defines an end of the opening 40 and one end edge of the door 4 that is disposed adjacent the opening 40 when the door 4 is in the open position. In certain other embodiments, the width $W_{AW}$ of the access window 42 may be defined by two lateral edges of the housing 2 that define the lateral sides of the opening 40, and the length $L_{AW}$ of the access window 42 may be defined by two end edges of the housing 2 that define the ends of the opening 40. In certain embodiments, the width $W_{AW}$ of the access window 42 may be approximately 0.55 inches (14 mm), and the length $L_{AW}$ of the access window 42 may be approximately 1.12 inches (28.57 mm), such that the access window 42 has an area of approximately 0.616 $in^2$ (397.42 $mm^2$). Although the opening 40 and the access window 42 are shown as having a rectangular shape, the opening 40 and the access window 42 may have a wide variety of shapes, including, but not limited to, square, oval, circular, or other suitable regular or irregular shapes, according to various embodiments. In certain embodiments, the access window 42 may have an area of approximately 0.616 $in^2$ (397.42 $mm^2$). In certain embodiments, the access window 42 may have an area greater than approximately 0.5 $in^2$ (322.58 $mm^2$). In certain embodiments, the access window 42 may have an area greater than approximately 0.6 $in^2$ (387.10 $mm^2$). In certain embodiments, the access window 42 may have an area between approximately 0.6 $in^2$ (387.10 $mm^2$) and approximately 0.7 $in^2$ (451.61 $mm^2$). In certain embodiments, the access window 42 may have an area between approximately 0.5 $in^2$ (322.58 $mm^2$) and approximately 0.8 $in^2$ (516.13 $mm^2$). In certain embodiments, the access window 42 may have an area between approximately 0.6 $in^2$ (387.10 $mm^2$) and approximately 0.75 $in^2$ (483.87 $mm^2$).

The door 4 is illustrated in detail in FIGS. 12-17. In certain embodiments, as shown, the door 4 may include four (4) living hinge sections 52 and five (5) door segments 54. In certain other embodiments, the door 4 may include a larger or smaller number of the living hinge sections 52 and the door segments 54. It will be appreciated that a larger number of the living hinge sections 52 may increase the flexibility of the door 4 but may weaken the integrity of the door 4. It also will be appreciated that a smaller number of the living hinge sections 52 may decrease the flexibility of the door 4 such that the door 4 may not be flexible enough to follow the curvature of the door tracks 50 and/or may create excessive friction between the door 4 and the door tracks 50 as the door 4 is moved therein.

Figure 15:
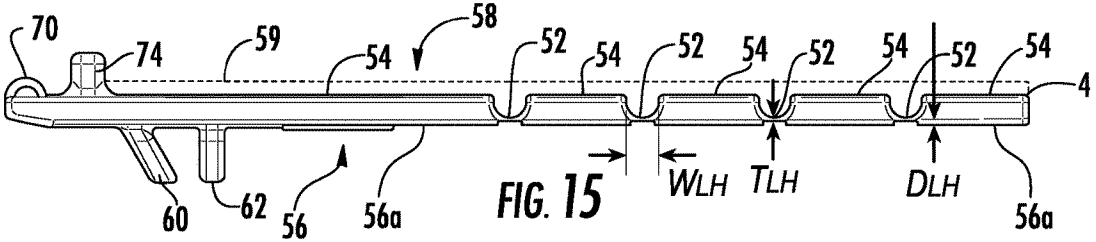
FIG. 15 is a detailed opposite side view of the door of FIG. 12.
Figure 16:
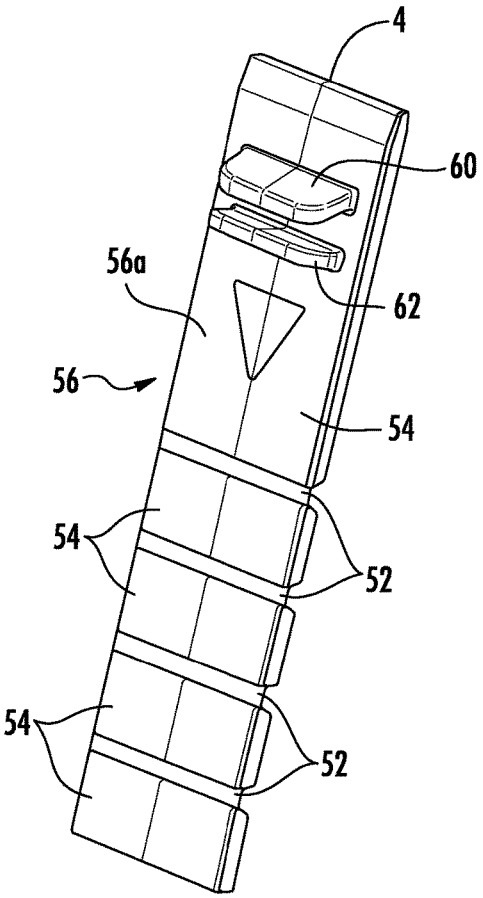
FIG. 16 is a front perspective view of the door of FIG. 12.
Figure 17:
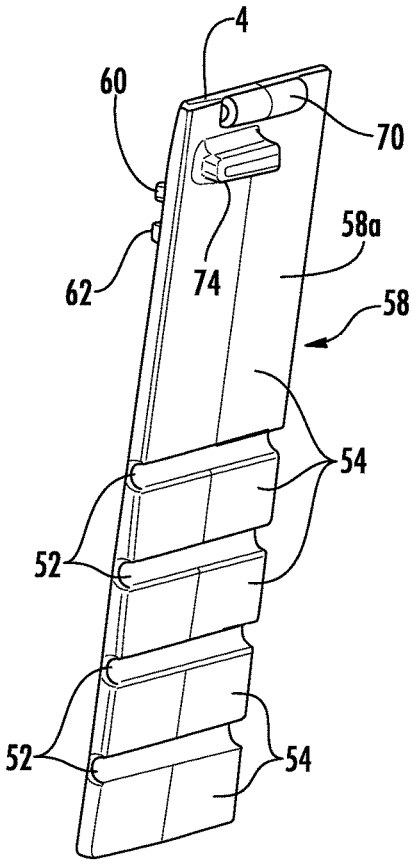
FIG. 17 is a back perspective view of the door of FIG. 12.

As shown, the door 4 may have an exterior side 56 (which also may be referred to as a "front side"), an exterior surface 56*a* (which also may be referred to as a "front surface"), an interior side 58 (which also may be referred to as a "back side"), and an interior surface 58*a* (which also may be referred to as a "back surface"). The living hinge sections 52 of the door 4 each may have a thickness $T_{LH}$ and a width $W_{LH}$ and may be sunk a distance $D_{LH}$ below the exterior surface 56*a* of the door 4, as shown in FIG. 15. In certain embodiments, the thickness $T_{LH}$ of the living hinge section 52 may be approximately 0.012 in. (0.3 mm), the width $W_{LH}$ of the living hinge section 52 may be approximately 0.059 in. (1.5 mm), and the sunk distance $D_{LH}$ may be approximately 0.008 in. (0.2 mm). Such dimensions may be suitable when the door 4 is made of polypropylene. In certain embodiments, the living hinge section 52 may include small radii of approximately 0.004 in. (0.1 mm) along the exterior side 56 of the door 4 and full radii of approximately 0.030 in. (0.75 mm) along the interior side 58 of the door 4. In certain embodiments, the door 4 may have a thickness of approximately 0.079 in. (2.0 mm) before draft, and the edges of the door 4 where the drafted door 4 interfaces with the door tracks 50 may have a thickness of approximately 0.053 in. (1.35 mm) after draft. In certain embodiments, the door 4 may include an overmold section 59 (which also may be referred to as an "overmold portion" or simply an "overmold") disposed along the interior side 58 of the door 4, as shown in FIG. 15 via dashed lines. In certain embodiments, the overmold section 59 may extend along the entire interior side 58 of the door 4. In certain other embodiments, the overmold section 59 may extend along only a portion of the interior side 58 of the door 4. As shown, the overmold section 59 may be disposed over the living hinge sections 52. In this manner, the overmold section 59 may reinforce the living hinge sections 52 and may prevent the door segments 54 from separating from one another even if one or more of the living hinge sections 52 were to fail due to fatigue cycling or excessive tensile load due to chalk buildup along the door tracks 50. The overmold section 59 also may serve to seal any cracks in the door 4, ensuring that chalk does not leak or escape from the chalk chamber 22 of the housing 2 through cracks in the door 4. The overmold section 59 further may provide a seal between the door 4 and the door tracks 50, preventing or minimizing any gaps between the door 4 and the door tracks 50 to ensure that chalk does not leak or escape from the chalk chamber 22 through such gaps.

In certain embodiments, the door segments 54 may be connected to one another by mechanical hinges other than the living hinge sections 52 described above. Such mechanical hinges may be snap-fit molded components that allow the door segments 54 to be snap-fit to one another at a pivoting hinge. The snap-fit door segments 54 may be configured to traverse the curvilinear door tracks 50 in a manner similar to the door segments 54 connected by the living hinge segments 52 described above. Rigid door segments 54 alternatively may be connected to one another by separate pins, such as steel pins, that engage knuckles at the respective ends of adjacent door segments 54. Although mechanical hinges may be used in certain embodiments, the use of the living hinge sections 52 may be the simplest and most cost effective arrangement, using fewer parts and simplifying manufacturing processes.

As shown, the door 4 may include a flange 60 (which also may be referred to as a "first flange" or a "retaining member") disposed along the exterior side 56 of the door 4. The flange 60 may be configured to receive and retain a portion of the end hook 38, as shown in FIGS. 1-10, such that the flange 60 may act as a "tie-down" to hold the first end 32*a* of the line 32 and the end hook 38 in a secure position during non-use of the chalk line 1. In certain embodiments, the flange 60 may be configured to receive and retain the free end of the end hook 38, as shown. The end hook 38 and the flange 60 may be shaped such that the free end of the end hook 38 may be positioned behind the flange 60. In certain embodiments, the end hook 38 may include an aperture 66 defined therein and configured to engage a projection 68 extending from the housing 2 adjacent the opening 40 and the door 4 (when the door 4 is in the closed position), as shown in FIGS. 1-10. The projection 68, the flange 60, and the end hook 38 may be configured such that the end hook 38 is held and maintained in a secure position against the housing 2 during non-use of the chalk line 1.

As shown, the door 4 also may include a second flange 62 (which also may be referred to as a "grip feature" or a "grip member") disposed along the exterior side 56 of the door 4. The second flange 62 may be configured to allow a user's finger to engage and grip the second flange 62 to facilitate opening and closing of the door 4 (i.e., manually moving the door 4 between the closed position and the open position. The second flange 62 may be disposed near but spaced apart from the first flange 60, as shown, defining a gap therebetween. In this manner, when the end hook 38 is received by the first flange 60, the free end of the end hook 38 may be disposed at least partially within the gap between the first flange 60 and the second flange 62.

Figure 11:
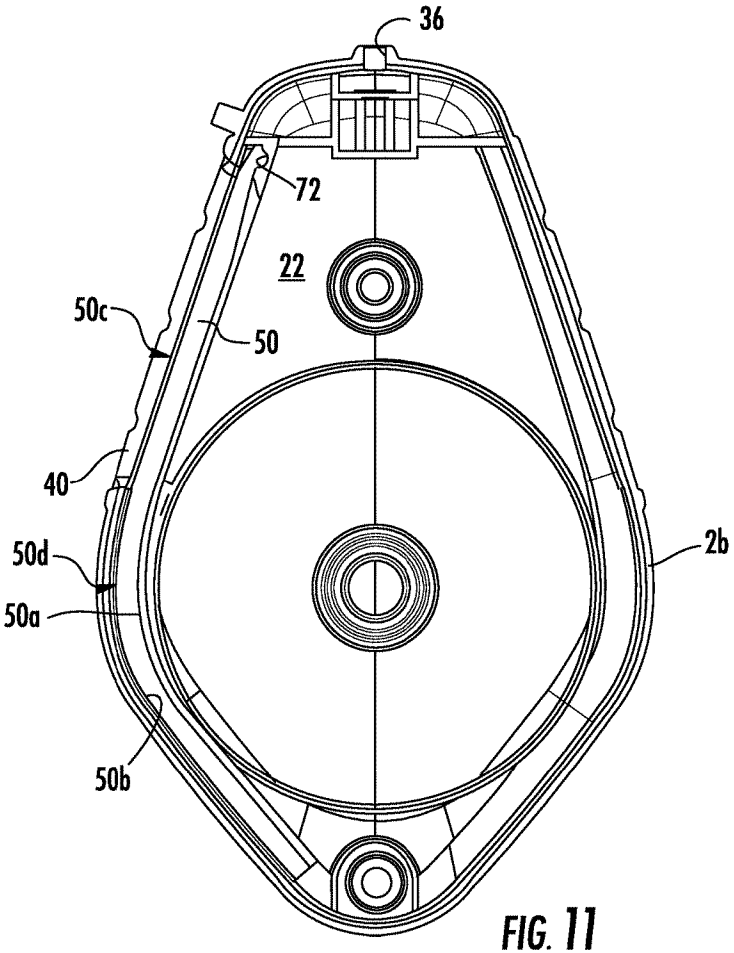
FIG. 11 is a front view of the back housing of the chalk line of FIG. 1.
Figure 10:
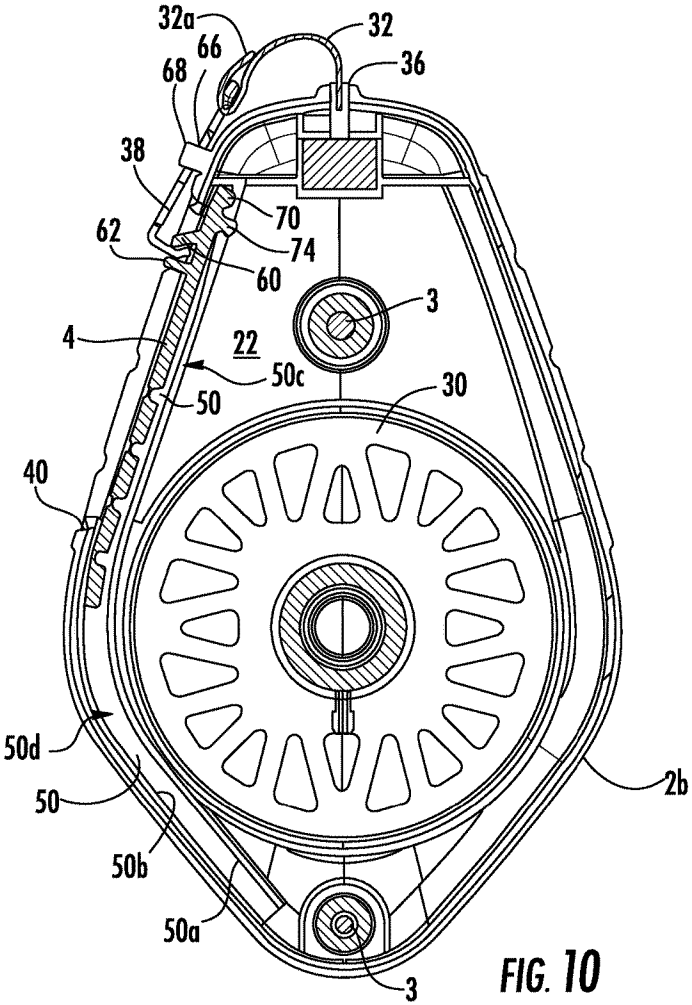
FIG. 10 is a cross-sectional view of the chalk line of FIG. 1 taken along line 10-10 of FIG. 2, with the door of the chalk line in the closed position.
Figure 12:
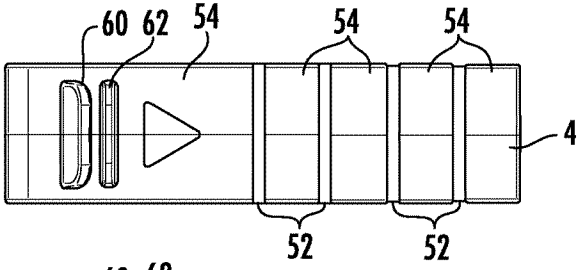
FIG. 12 is a front view of the door of the chalk line of FIG. 1.
Figure 13:
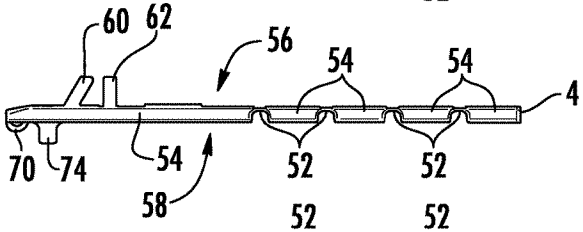
FIG. 13 is a side view of the door of FIG. 12.
Figure 14:
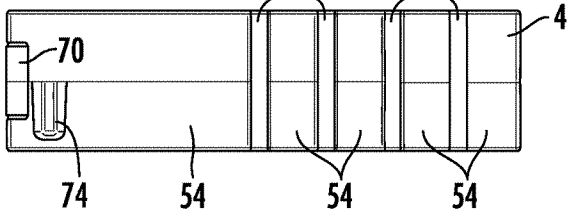
FIG. 14 is a back view of the door of FIG. 12.

The door 4 may include a pair of projections 70, 74 disposed along the interior side 58 of the door 4 near a free end of the door 4. The first projection 70 may be formed as a nub or a protrusion, although other forms of the first projection 70 may be used. As shown in FIGS. 10 and 11, the first projection 70 may be configured to engage a mating receptacle 72 defined in the housing 2 at or near an end of each of the door tracks 50 such that engagement of the first projection 70 with the mating receptacles 72 locks the door 4 in the closed position. In other words, the mating receptacles 72 may be configured to removably receive and retain a portion of the first projection 70. In this manner, the first projection 70 and the mating receptacles 72 may collectively form a lock 73 configured to maintain the door 4 in the closed position. The engagement of the first projection 70 with the mating receptacles 72 may be overcome by applying an opening force to the door 4 that deforms the first projection 70, the mating receptacles 72, or both, and/or that allows the first projection 70 to ride over an edge of the mating receptacles 72 to disengage the lock 73. Although the lock 73 is shown as including the first protrusion 70 of the door 4 and the mating receptacles 72 of the housing 2, the lock 73 alternatively may be configured such that the first protrusion 70 is a part of the housing 2 and the mating receptacles 72 are defined in the door 4.

The second projection 74 (which also may be referred to as a "catch projection" or a "catch") may be formed as a nub or a protrusion, although other forms of the first projection 74 may be used. As shown, the second projection 74 may be disposed near but spaced apart from the first projection 70, defining a gap therebetween. The second projection 74 may be configured to limit the distance that the door 4 may move along the door tracks 50 in an opening direction. In particular, the second projection 74 may be configured to engage a third projection 76 (which also may be referred to as a "stop projection" or a "stop") of the housing 2 to limit the distance that the door 4 may move along the door tracks 50 in the opening direction. In certain embodiments, the third projection 76 may be formed on one of the front housing 2*a* and the back housing 2*b*. For example, as shown in FIG. 9, the third projection 74 may be formed on the front housing 2*a*. In certain other embodiments, a pair of the third projections 76 may be provided, one of the third projections 76 formed on each of the front housing 2*a* and the back housing 2*b*. In certain embodiments, as shown, the second projection 74 and the third projection 76 may be configured to prevent the door 4 from moving some or all of the way into the housing 2 when the door is moved in the opening direction. In this manner, as described above, when the door 4 is in the open position, the opening 40 and the door 4 may define the access window 42 therebetween.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments. Finally, the term "plurality" means two or more, and when used in the description and/or claims indicates a plural number of respective elements.

That which is claimed is:

1. A chalk line comprising:

a housing defining a chalk chamber and an opening in communication with the chalk chamber;

a track disposed within the chalk chamber and adjacent the opening, the track comprising a curved section;

a door movable within the track between a closed position preventing access to the chalk chamber through the opening and an open position allowing access to the chalk chamber through the opening, the door comprising a plurality of door segments pivotably connected to one another by a plurality of hinges;

a spool disposed within the chalk chamber;

a line supported by the spool, the line comprising a first end extending outside of the housing; and an end hook attached to the first end of the line and configured to removably engage the door.

2. The chalk line of claim 1, wherein the door is made of a relatively flexible material.

3. The chalk line of claim 2, wherein the relatively flexible material comprises polypropylene.

4. The chalk line of claim 1, wherein the hinges comprise living hinges.

5. The chalk line of claim 1, wherein the curved section follows a curved exterior shape of the housing.

6. The chalk line of claim 1, wherein the curved section follows a curved exterior shape of the spool.

7. The chalk line of claim 1, wherein the door further comprises an overmold portion disposed along an interior side of the door and extending over the hinges.

8. The chalk line of claim 1, wherein the door further comprises a retaining member disposed along an exterior side of the door and configured to removably engage and retain a portion of the end hook.

9. The chalk line of claim 8, wherein the housing comprises a projection configured to removably engage an aperture defined in the end hook.

10. The chalk line of claim 1, further comprising a lock configured to maintain the door in the closed position.

11. The chalk line of claim 10, wherein the lock comprises a projection disposed on one of the door and the housing, and a receptacle defined in another one of the door and the housing and configured to removably receive and retain a portion of the projection.

12. The chalk line of claim 1, wherein the housing comprises a stop projection, and wherein the door further comprises a catch projection configured to engage the stop projection to limit movement of the door in an opening direction.

13. The chalk line of claim 1, wherein the opening and the door define an access window when the door is in the open position, and wherein the access window has an area of approximately 0.616 $in^2$.

14. The chalk line of claim 1, wherein the opening and the door define an access window when the door is in the open position, and wherein the access window has an area greater than 0.5 $in^2$.

15. The chalk line of claim 1, wherein the opening and the door define an access window when the door is in the open position, and wherein the access window has an area greater than 0.6 $in^2$.

16. The chalk line of claim 1, wherein the opening and the door define an access window when the door is in the open position, and wherein the access window has an area between 0.6 $in^2$ and 0.7 $in^2$.

17. The chalk line of claim 1, wherein the opening and the door define an access window when the door is in the open position, and wherein the access window has an area between 0.5 $in^2$ and 0.8 $in^2$.

18. The chalk line of claim 1, wherein the opening and the door define an access window when the door is in the open position, and wherein the access window has an area between 0.6 $in^2$ and 0.75 $in^2$.

19. A chalk line comprising:

a housing defining a chalk chamber and an opening in communication with the chalk chamber;

a pair of tracks disposed adjacent the opening, each of the tracks comprising a linear section and a curved section; and a door movable within the tracks between a closed position preventing access to the chalk chamber through the opening and an open position allowing access to the chalk chamber through the opening, the door comprising:

a plurality of door segments pivotably connected to one another by a plurality of living hinges; and an overmold portion disposed along an interior side of the door and extending over the living hinges.

20. A chalk line comprising:

a housing defining a chamber and an opening in communication with the chamber;

a track disposed within the chamber and along an interface between the chamber and the opening; and a door movable within the track between a closed position preventing access to the chamber through the opening and an open position allowing access to the chamber through the opening, the door comprising a plurality of door segments pivotably connected to one another by a plurality of hinges.

* * * * *